United States Patent [19]

Imbert

[11] 4,092,987

[45] June 6, 1978

[54] CIGAR-LIKE PRODUCT

[75] Inventor: Pierre Imbert, Paris, France

[73] Assignee: Service D'Exploitation Industrielle des Tabacs et des Allumettes, Paris, France

[21] Appl. No.: 717,569

[22] Filed: Aug. 26, 1976

Related U.S. Application Data

[63] Continuation-in-part of Ser. No. 432,060, Jan. 9, 1974, abandoned.

[30] Foreign Application Priority Data

Jan. 12, 1973 France ..... 73.00987

[51] Int. Cl.[2] ..... A24D 1/00; A24C 5/18

[52] U.S. Cl. ..... 131/8 R; 131/84 A

[58] Field of Search ..... 131/8 R, 1, 9, 20 R, 131/20 A, 21 R, 70, 80, 21 C, 81, 84 R, 84 A, 77, 85, 86, 136

[56] References Cited

U.S. PATENT DOCUMENTS 1,479,458 1/1924 De La Mota ..... 131/8 R

FOREIGN PATENT DOCUMENTS 440,484 1/1936 United Kingdom ..... 131/136

*Primary Examiner*—Robert W. Michell
*Assistant Examiner*—V. Millin
*Attorney, Agent, or Firm*—Jacobs & Jacobs

[57] ABSTRACT

A smokable cigar-like product whose interior is formed from prepared fragments of natural or manufactured tobacco leaves. The fragments have an irregularly contoured main surface which is generally larger in all its dimensions than the thickness of the original leaves. The orientation of the fragments is such that at least one line parallel to the main axis of the product passes through the major part of the fragments encountered at an angle of incidence which is greater than zero, for example, greater than fifteen degrees.

2 Claims, 12 Drawing Figures

CIGAR-LIKE PRODUCT

CROSS REFERENCE

This is a continuation-in-part of Ser. No. 432,060 filed Jan. 9, 1974, now abandoned.

DETAILED DESCRIPTION

The present invention relates to the manufacture of smokable articles of the class of cigars, in particular cigar-like products.

"Smokable articles" include several types of products sold under different names such as cigars, cigarillos, cigarettes, and the like. Originally smokable articles of the class of cigars were distinguished in part from those of the class of cigarettes by the nature or the number of the surrounding envelopes but different presentations of reconstituted tobacco in bands has permitted the use of techniques of the cigarette industry in the production of products of the cigar type. The format of division of the interior tobacco of the products, on the other hand, remains determinant since it, more than the nature of the envelope, conditions the rate of combustion of the article, and the rate of combustion influences to a large extent the distinctive taste and the chemical composition of the smoke produced.

The interior of cigarettes is thus usually constituted by elongate strands, the width of which is mostly between a few tenths of a millimeter and 1 millimeter. A strand width of two millimeters is, for example, considered as exceptional. The strand width is moreover, for each product, well determined. The fine cut (scaferlati) from which cigarettes are prepared is manufactured in chopping machines which effect a transverse cut of the leaves (or leaf-like elements) with a uniform pitch in operation. The fact that some cigarettes are prepared from a mixture of several sorts of fine cut chopped tobacco having different cutting widths does not render invalid this criterion of distinction.

The interior tobacco of cigars, on the other hand, is characterized by fragments the dimensions of which are much more irregular. The general shape is essentially non-linear as compared with the fine scaferlati cut strands of cigarettes. For example, while it is not always easy to distinguish with the eye the width of the cut from the thickness (of the initial leaf or leaf-like element) with a scaferlati cut, the initial thickness of the leaf is immediately discernable for most of the fragments utilized in cigars. This dimensional difference is extremely critical to the characteristics of the final product and is herein utilized to distinguish the class of smokable articles termed "class of cigars" or "cigar-like products" from other smokable products. Other criteria traditionally adopted for defining these articles, such as the natural or industrial origin of the leaves employed for obtaining the interior fragments and the envelopes or wrappings, are not pertinent to the present invention.

Two main families of processes and machines are known for the manufacture of cigar-like products. According to the most ancient technique, quantities of interior tobacco are prepared in sequences, the cross-section of which is the image of the transverse section (or module) of the articles to be manufactured, and each of these is rolled in an envelope previously cut out. This technique is referred to hereinafter as the "traditional process."

Another technique, the "continuous roll process," which appeared since the advent of reconstituted tobacco in long coils of small width, employs cigar machines similar to cigarette manufacturing machines. A feeder of interior tobacco pieces thus pours a supply stream, which is as even as possible, onto a narrow conveyor belt. The conveyor belt carries this stream of small section to shaping means, where the stream is shaped into a cylindrical roll of given section, and conveys it to another conveyor belt. On this belt is a reconstituted tobacco sheet which is unwound from a rell at a speed equal to that at which the roll arrives. Means for applying adhesive to the edge portion of the sheet, enveloping the roll, drying the adhesive and fixing the diameter, precede means for transversely cutting the roll into sections of equal length as on machines for manufacturing cigarettes.

Studies on a very large number of products of the group of cigars manufactured both by the traditional process and the continuous roll process have confirmed that which a rapid observation already appeared to indicate, namely that the directional distribution of the fragments within these products follows a permanent statistic law irrespective of the machines employed for their manufacture. Cuts in planes perpendicular to the axis of the cigars and in planes parallel to this axis reveals that most of the fragments bend, roll up or fold about one or more lines which are approximately parallel to the longitudinal axis of the article. All these products have a stratified structure resulting from a well-understood tendency of the fragments to hold together or inter-engage in the preferred direction indicated hereinbefore. Without analyzing all the factors contributing to this orientation, it is apparent that all the conventional means for ramming and/or compressing the dollies in the course of formation combine to accentuate this tendency.

This stratified structure promotes the drawing of the smoke towards the head of the ignited cigar, since there thus exists between the various fragments laminar passage channels oriented in the direction of its flow. A more thorough study carried out on a large number of articles whose geometric characteristics and constitution are as close as possible and in which solely the compression of the interior fragments varies, shows however that it is difficult under these conditions to conciliate an optimum drawing and optimum compactness. Cigars manufactured at the present time which possess a very regular draw are most often somewhat soft to the touch whereas cigars which react well to transverse compression have a tendency to burn more irregularly and, sometimes, go out spontaneously. Thus as would be expected, compactness increases with density so that for a cigar of given diameter and length an increase in weight will result in greater compactness. However the draw, or draft is also inversely proportional to density. In order to avoid excessive draft, it is of course necessary to employ a certain minimum amount of tobacco. Above this limit, the draft decreases as density increases. These two factors, compactness and draft, thus establish fairly rigid density limits within which a cigar-like product must fall if it is to have acceptable properties.

In the traditional process of manufacture, these opposing factors are satisfied and the limits met by taking extreme care in the choice of the quality of the interior tobaccos, in the dimensioning of the fragments and in their regular distribution. These precautions are costly from all points of view, including starting material efficiency of the machines and labor. In the continuous roll process, machine operators tend, for the purpose of ensuring higher operational reliability, to manufacture cigars having a high compactness and thus draw resistance is liable to be found excessive. This high compactness also results in a use of an uneconomical amount of interior tobacco, exceeding that required for the satisfaction of the smoker.

A reduction of the density would be highly desirable but as noted above, the reduction in the amount of tobacco below a rather well defined limit produced inadequate compactness and excessive draft.

The present invention produces cigar-like products in which the interior tobacco fragments are not allowed to follow the law of stratification; i.e., an orientation parallel to the longitudinal axis. Rather a large part of the fragments are oriented in a direction roughly perpendicular to this axis. Surprisingly the articles produced in this way, which one might reasonably fear would be smokable only with difficulty, possess a satisfaction draw and combustibility. Upon analysis, their smoke appears to be less charged with elements considered harmful than that of conventional cigars having a similar weight. More significantly, it was observed that for a given apparent compactness, the mean weight of the new cigars is much less than that of conventional cigars, manufactured either by the traditional process or the usual continuous roll process. Thus for given dimensions, the novel cigar-like products had a lower density yet comparable draft and compactness to conventional cigars.

Although the saving in the amount of interior tobaccos employed justified the inherent complications in the industrial manufacture of this new product, it has been possible to also improve the machines for manufacturing existing cigars by adding thereto special devices and/or by modifying their condition of use. These devices can be adapted to a large number of machines operating by the traditional process or by the continuous roll process. It is thus possible to manufacture, on an industrial scale and with no loss of production, the new cigar-like products having hitherto unknown features and incontestable qualities.

In particular these articles are differentiated from those previously known by the fact that, in piercing them in a direction parallel to their longitudinal axis, a larger proportion of fragments is encountered and traversed in the direction of their initial thickness than that of a similar article of the known type having the same characteristics, i.e. the same compactness and the same draft. By way of indication, in the body portion of a finished cigar according to the invention with the ends excluded the ratio between said proportions may exceed thirty percent. The invention therefore concerns cigars having this feature, their process of manufacture by the traditional process or the continuous roll process, and devices for carrying out said process, irrespective of the nature (plant, reconstituted or synthetic) of the interior fragments or of the product enveloping sheets.

The process by which these novel products are formed involves successive operations: forming a rod of given shape with solely interior tobacco fragments, compressing the rod in the direction of its longitudinal axis while maintaining the initial transverse sections substantially constant, and enveloping or wrapping this rod with a smokable sheet usually combustible which closely surrounds it so as to ensure that the fragments are coherently maintained in the orientation they assumed after the preceding longitudinal or axial compression.

Various modifications may be made in this general manner of proceeding, which is a feature of the invention, without departing from the foregoing general principles. Thus the initially constituted "rod" may correspond to the length of one, two or even three finished articles after longitudinal compression or it may be an element of a continuous roll. The cross section of the initial rod may be constant throughout its axis, or, on the contrary, it may be modulated in accordance with the shape of the desired finished article. The active longitudinal compression may be exerted in a single direction or, in some cases, at both ends of the rod. The fragments, before forming the rod, may be classified and/or oriented in a preferential manner, whereas in in other cases they are fed in a regular manner but in bulk.

In the following examples of the use of the devices according to the invention, these different ways of carrying out the general process will be recognized. It will be understood that others could be imagined while retaining the determinant element of the process which consists in ensuring, by a large longitudinal compression the maintenance in a general direction roughly perpendicular to the axis of the rod, of fragments which would already have this orientation, while promoting the assumption of this orientation by other fragments which initially did not have it. This manner of proceeding is very different from processes hitherto employed for manufacturing cigars in which there is exerted radial compression; i.e., compression in the direction towards rather than with the axis of the article.

The examples of carrying out the invention are illustrated in the following figures of the accompanying drawings in which.

Figure 1:
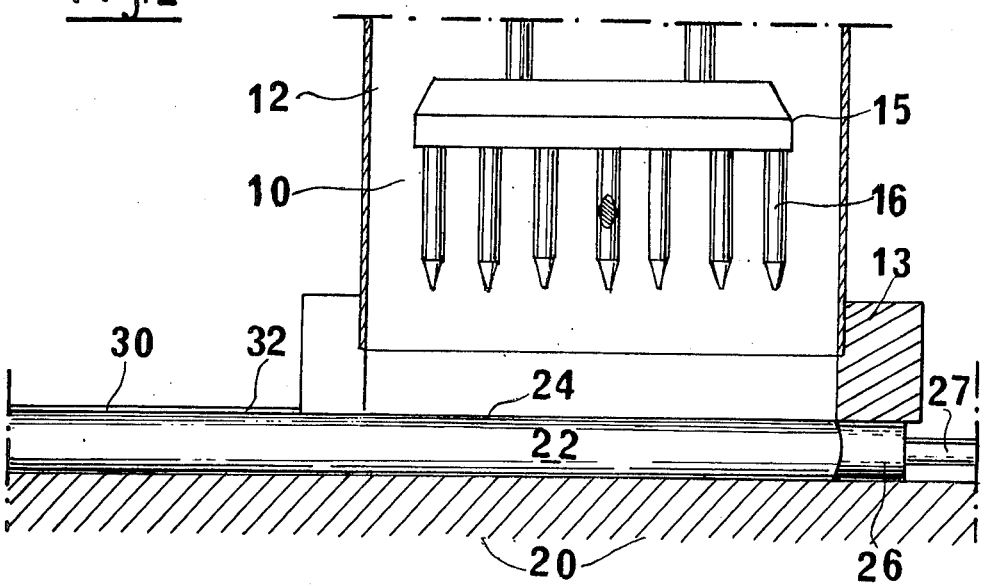
FIG. 1 is a partial vertical sectional view of a discontinuous device for manufacturing cigars according to the invention, taken on line I—I of FIG. 2.
Figure 2:
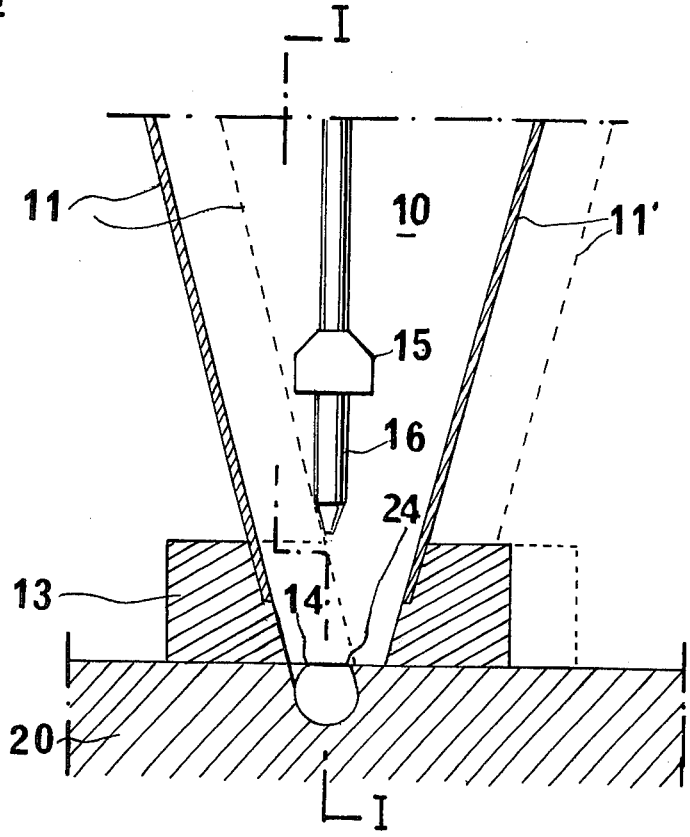
FIG. 2 is a vertical sectional view perpendicular to that of FIG. 1.
Figure 3:
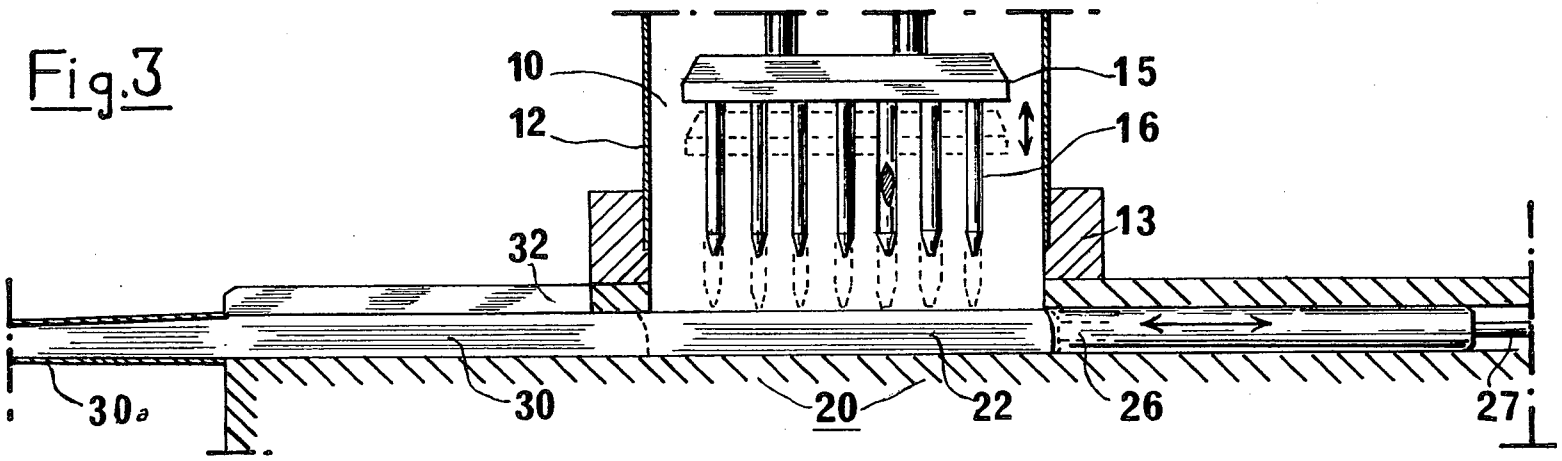
FIG. 3 is a sectional view similar to FIG. 1 of a slightly modified embodiment of this device.

A device as shown in FIGS. 1 and 2 or in FIG. 3 permits the discontinuous or the semi-continuous manufacture of cigars according to the invention and is not without a certain similarity with the old ramming machines designed for the manufacture of cigarettes. However, this device differs therefrom in respect of various details and in its operation, the latter difference being due to the totally different behavior of the strands of cigarette tobacco and of the fragments of tobacco leaves constituting the interior of cigars.

This device comprises a feed hopper 10, mainly defined by two inclined walls 11 and 11' which are convergent toward groove 22 formed in a fixed table 20. In the embodiment shown in FIGS. 1 and 2, feed tank 10 is movable with respect to table 20 in a direction perpendicular to the axis of groove 22. The stand 13, on which the walls 11 and 11' are mounted, slides on the upper surface of this table between the position shown in full line and that shown in dotted line in FIG. 2. Edges 14 of stand 13 and edges 24 of the table alongside the groove 22 cooperate in the course of the displacement between these two positions to shear the fragments of tobacco which fill groove 22 but still extend into the feed tank 10.

An agitator 15, which may be movable or fixed (as shown in FIGS. 1 and 2) can be placed in the tank 10. The agitator comprises vertical cylindrical rods 16 having a substantially elliptical cross-sectional shape. In the course of the reciprocations of the feed hopper 10, these rods stir the mass of interior tobacco which fills the tank and counter the tendency of the fragment, to accumulate flat on top of each other and facilitate the descent of the fragments to the groove 22, if only because of the slight blow exerted on the wall 11 at the end of travel. By way of a modification, the agitator 15 may be made to undergo a vibratory movement or an up and down reciprocating movement as shown in FIG. 3*a*, which mechanism is well known in cigar machines operating discontinuously.

Pusher 26 on actuating rod 27 is slidably mounted and capable of traveling through the entire length of the groove and entering the orifice of guide tube 30 which extends the groove. The length of groove 22 itself preferably corresponds to the amount of tobacco corresponding to a small whole number of cigars (for example 1 or 2 cigars), although in fact it is distinctly longer than the total finished length of these articles since the metered quantities of fragments thus defined are subsequently compressed longitudinally or axially. In a first part (shown only in FIG. 1), the tube 30 maintains the same cross-section as the groove 22. It is here integral with the table 20. At its end, the tube 30 is slightly convergent and extends beyond the table as can be seen in FIG. 3. A narrow slot 32 can be provided in the upper part of tube 30 to permit an easier cleaning of the latter without permitting any loss of tobacco due to the area of the fragments employed.

The embodiment shown in FIG. 3 differs from that shown in FIGS. 1 and 2 only in that the feed tank 10 is fixed and the agitator 15 is movable. The body of the pusher 26 is also slightly longer that the groove 22.

The operation of these devices will be easy to understand from the foregoing description thereof. The feed tank is filled up to a given level (which is thereafter maintained as constant as possible) with fragments of tobacco leaves (natural or partly reconstituted) having a particle size depending upon the section of the desired cigar and therefore to the dimension of the groove 22. The latter is filled with fragments in a haphazard manner with rods 16 of the agitator 15 countering the general tendency for stratification. The displacement of the feed tank toward the position shown in dotted line in FIG. 2 thereafter defines the quantity of tobacco dispensed, corresponding to one or two cigars according to the dimensions chosen for the different elements.

The density of the fragments filling the groove 22 is less than that of the finished article. A rapid displacement of the pusher 26 causes the longitudinal compression of the fragments of leaf in the cylindrical part of the tube 30 which brings about or confirms their orientation with a non zero incidence with respect to the axis of the tube. Upon the next displacement of pusher 26 in the same direction, the dose thus prepared is expelled at the downstream end of tube 30 where it is collected in a rolling sheet already looped as in prior art cigar machines or in a more continuous enveloping or wrapping device if there is employed a band of reconstituted tobacco. The slight conicity of the end part of tube 30, shown in FIG. 3, facilitates the transfer to the rolling or wrapping device and moreover affords a slight radial compression of the fragments but only after the prior orientation has been definitely fixed.

Figure 4:
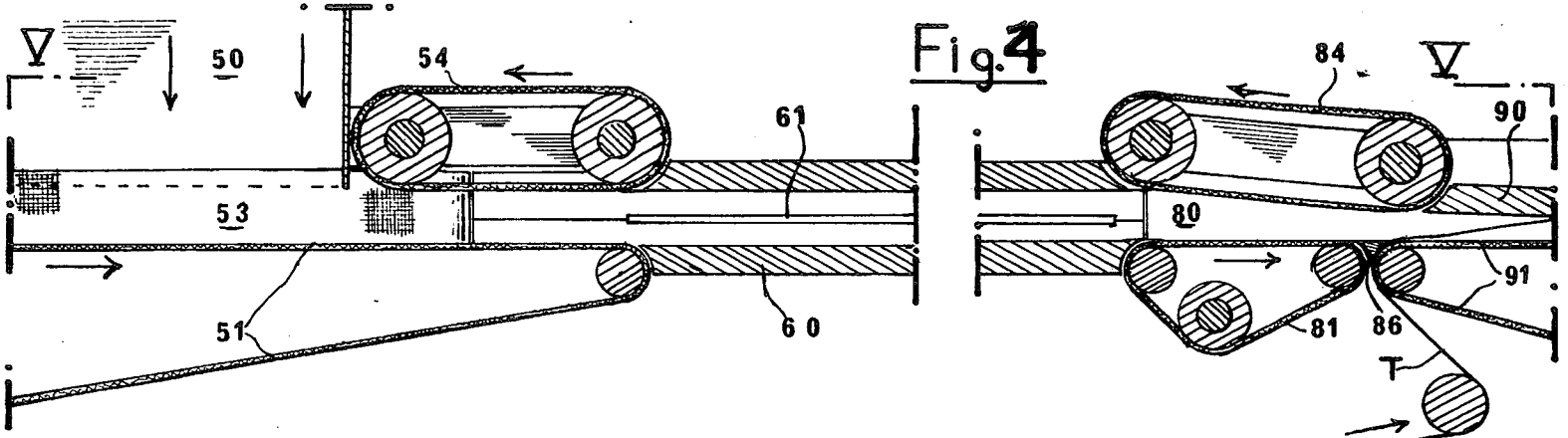
FIG. 4 is a partial vertical sectional view on the longitudinal axis of a continuous device for manufacturing cigars according to the invention.
Figure 5:
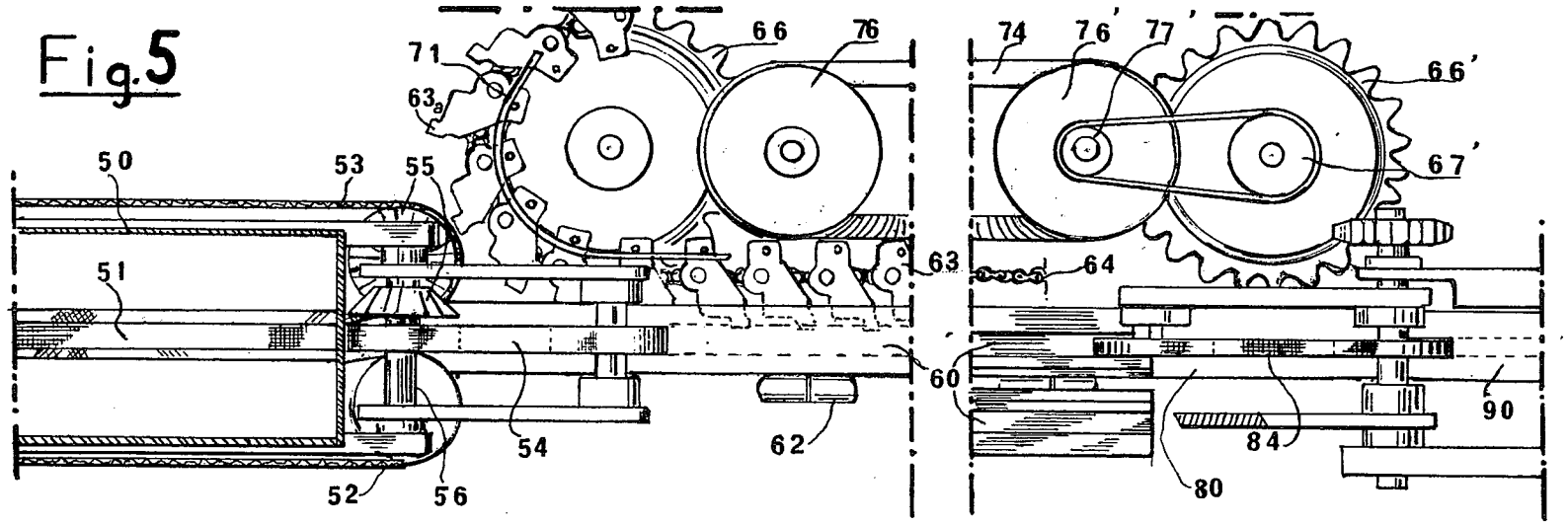
FIG. 5 is a top plan view of the device shown in FIG. 4 partly in section on the line V—V of FIG. 4.
Figure 7:
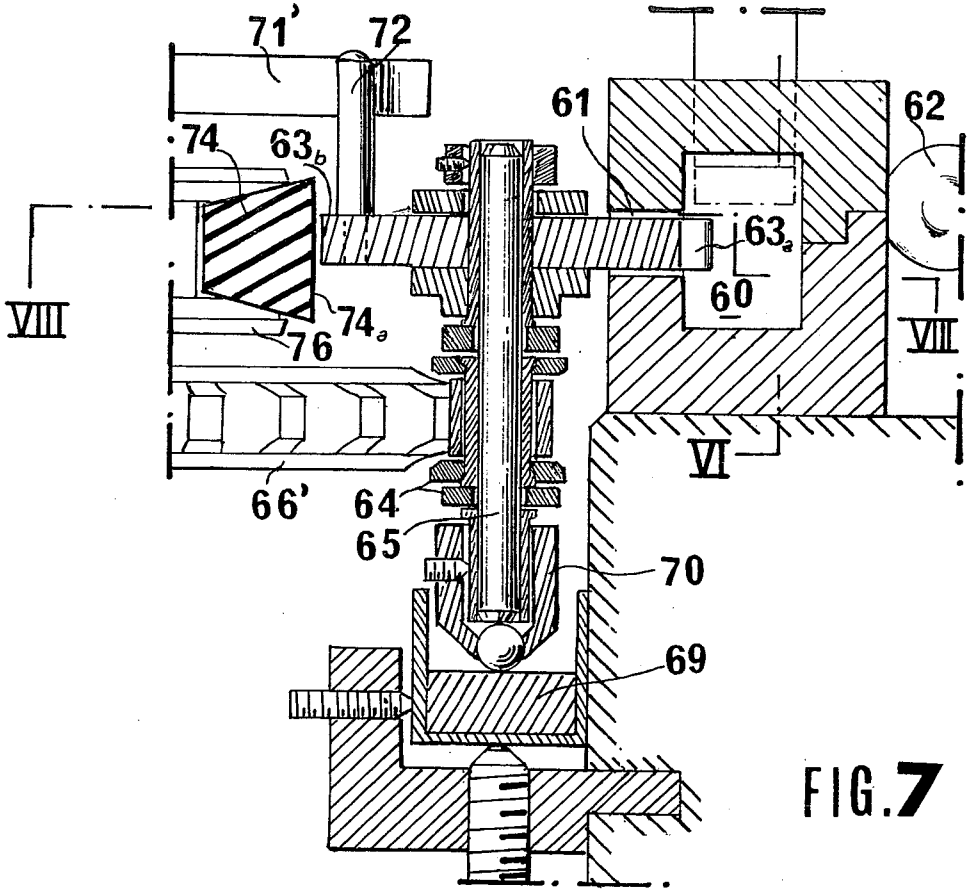
FIGS. 6, 7 and 8 are detail views of an improvement of the device shown in FIG. 4.
Figure 6:
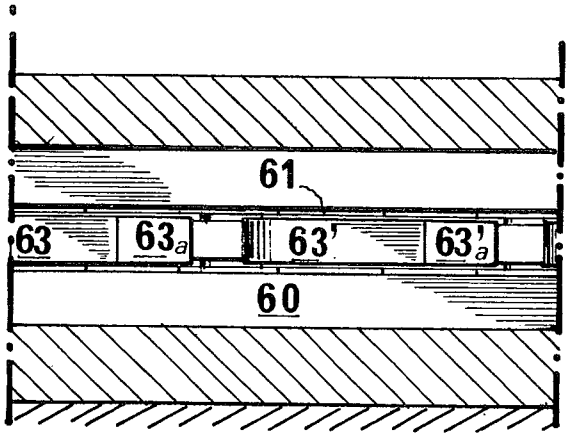
Figure 8:
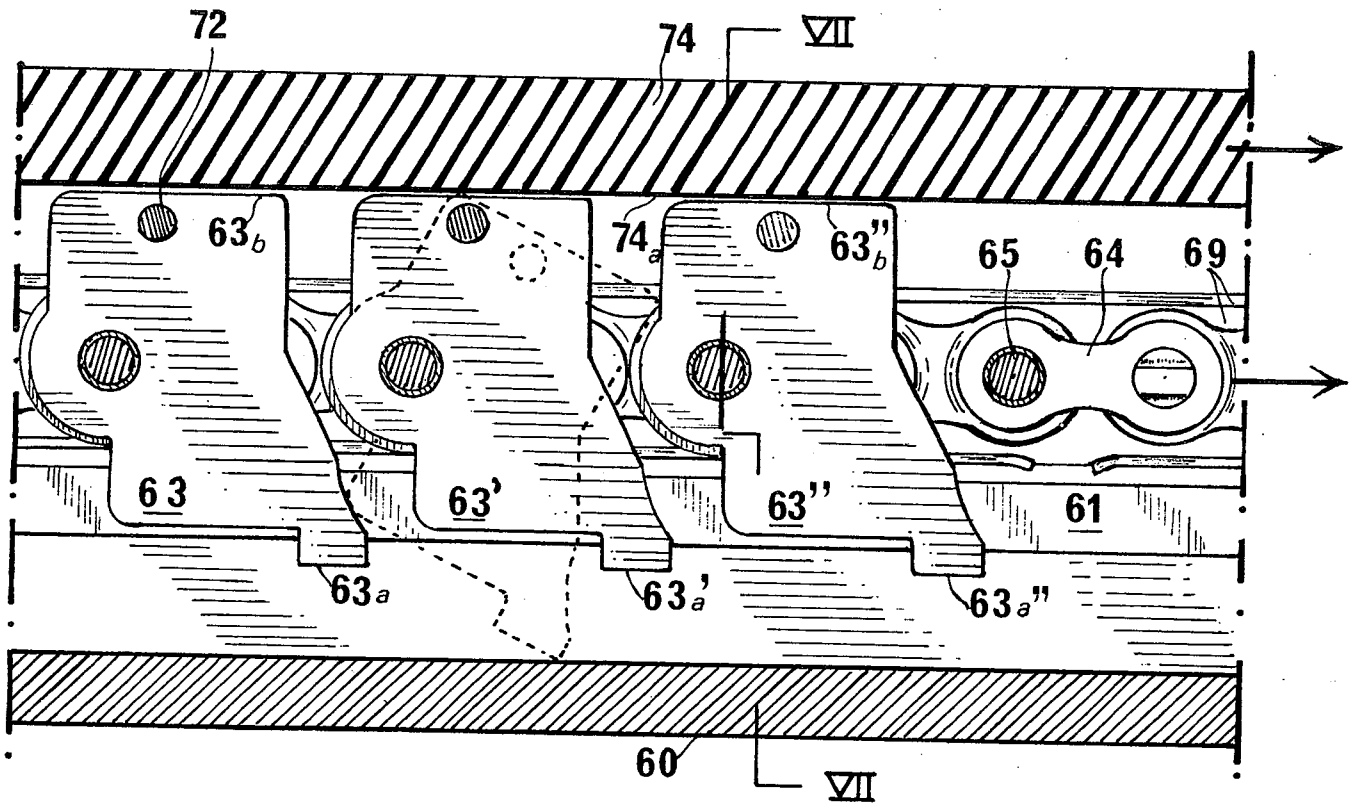

The continuous cigar manufacturing device according to the invention, shown in FIGS. 4, 5 and 6 with some details or additions shown in FIGS. 7 and 8, is derived from machines designed to produce cigars or cigar dollies wrapped in one or more envelopes or wrapping of reconstituted tobacco, this envelope being unwound from a narrow reel. These machines, whose technique is similar to those used in the manufacture of cigarettes by the continuous roll process, are well known and their general description can be correpondingly short.

These machines comprise a feeder (general reference numeral 50) which delivers the interior tobacco of the cigars to a plurality of conveyor belts. In the illustrated type there are four conveyor belts, a lower belt 51 passing under the feeder, two lateral belts 52 and 53 defining the base of the latter and an upper belt 54 which acts only on the downstream side of the other three belts. These belts are driven by drive pulleys and extend around direction-changing pulleys, only some of which are shown. The speeds of these belts, which are usually capable of being regulated independently from the speed of the feeder, are here held invariable with respect to each other with the speeds moreover being as close to each other as possible. All of these belts are thus driven through the same shaft by pairs of bevel gears such as that shown at 55. The upper belt 54 is bodily pivotable about its drive shaft 56' to allow access to the passageway where the stream of tobacco from the feeder is collected.

The second part of the machine through which this stream passes is a stationary passageway 60, called a fixed passageway, which performs the important function in the forming of cigars according to the invention. The inner section of this passageway is of the same order as that of the passageway defined by the four aforementioned belts. Arranged in succeeding relation to the passageway 60 (which can be opened about hinges 62 for cleaning) there is a space defined between belts 81 and 84 and fixed elements 80 which performs a funnelling function, the inclination of the belt 84 to the axis of the roll promoting radial compression. This funnel action conducts the stream to member 90 in which penetrates the winding belt 91 carrying the envelope or wrapping band of reconstituted tobacco T which is unwound from a reel (not shown). This third part of the device is similar to the corresponding section of known machines and operates as follows. Feeder 50 pours the fragments of interior tobacco, detached from each other, with the best possible regularity onto bottom belt 51. The latter is driven at a speed significantly higher than that at which the roll of cigar is manufactured. Lateral belts 52 and 53 and upper belt 54 are driven at the same speed as the belt 51. Thus the flow of tobacco remains, in the upstream part of the passageway defined by these four belts, in the same profusion as under the feeder 50. Although the fragments which constitute it have a tendency, as in the known devices, to form a stratified structure parallel to the upper plane of the belt 51, they maintain a high mobility with respect to each other which will be utilized in the course of the following stage of the manufacturing process.

During the passage of the stream through the fixed passageway 60, this stratified loose structure is disorganized by the rubbing of the outer fragments against the walls, combined with the thrust exerted by the following fragments constantly brought to a speed of the order of that of belts 51 and 54. Many fragments therefore have a tendency to assume a position lying across the stream, some thereof thus presenting their main surface roughly perpendicular to the axis of the roll in course of formation. There is produced, at the same time, a longitudinal compression of the stream since, for a given section, the output speed of passageway 60 is much lower than the input speed. This first compression ensures that the fragments of tobacco, which are redistributed in a much more satisfactory manner, do not return to the conventional stratified structure under the effect of subsequent formings.

Especially if the particle size of the fragments of interior tobacco have a predominance of large pieces, the slowing down and the compression produced by the passageway 60 can produce jamming; i.e., the complete stoppage of the progression of the stream in this passageway and then downstream of the passageway formed by belts 51 and 54. A longitudinal slot 61 formed in the walls of the passageway 60 allows a manual intervention in response to a signal from a jamming detector. Such a detector may respond either to a rise in the internal pressure of the tobacco or to a drop in its permeability to air, or to the absence of the stream at the outlet of the passageway 60, and bring about the immediate stoppage of the machine. In the event of a very compact jamming, the passageway 60 could be opened about the hinges such as 62 and the over-agglomerated fragments of tobacco removed. However, in order to avoid these disturbances, it is preferable to equip the slot 61 with a device such as that shown in FIGS. 7 and 8 which can ensure the elmination of any accumulation of material in the passageway as soon as a tendency to this accumulation appears.

The active part of this device is mainly constituted by extracting finger members 63, 63', 63'', etc. which are mounted to pivot pins 65, 65', etc. extending from an endless chain 64. This roller chain, of which every other pin extends very distinctly beyond the exterior of the limits on each side of the chain, is driven by sprocket wheel 66' (itself driven by the general drives of the machine), passes over a tensioning pulley (not shown) and returns in the vicinity of the passageway 60 by engaging sprocket wheel 66.

The distance between the shafts of the sprocket wheels 66—66' and the axis of the passageway 60 is so adjusted that soley part **63*a*, the most remote from the pin 65 of an extracting finger member 63, normally penetrates (very slightly) the interior of the passageway 60. The rubbing-free passage of part 63 in slot 61 is ensured by the adjustable stiffening device for chain 64. This device comprises a guide 69, adjustable in height, and ball-carrying sockets 70 mounted at the base of projecting pins 65**.

Finger members 63 are guided in the input and output ends of the passageway 60 by ramps 71 and 71' of which only the ramp 71 has been shown in FIG. 5. These act on cylindrical pins 72 which extend above the plane of extracting finger members. As soon as their front part **63*a* has penetrated the passageway 60, the extracting finger members are no longer retained by ramps 71 but are merely prevented from accidentally pivoting by a belt 74. This belt 74, which is for example trapezoidal, passes around grooved pulleys 76 and 76', the latter pulley being driven through a belt (or a chain) by the drive sprocket wheel 66' of the chain 64. As the ratio between the shafts 67' and 77' is preferably that between the diameters of their respective wheels 66' and 76', the speed of the belt 74 is identical to that of the chain 64. Thus, the outer surface 74*a* of this belt is capable of traveling with no marked displacement with respect to the rectilinear parts 63*b* of the extracting finger members 63 outside the passageway 60 and the finger members are normally remained in the position shown in full line in FIG. 8**.

The operation of the second and third parts of the device for manufacturing cigars continuously is therefore as follows. Lower belt 81 and upper belt 84, which convey the roll issuing from the passageway 60 to forming funnel 80 (long finger) and to member 90, have a speed substantially equal to that of the flexible belt 91 of the envelope or wrapping which penetrates the member and carries the band of reconstituted tobaccos T. This speed, which is much less than that of the belts 51, 52, 53 and 54 conveying the tobacco in profusion from the feeder 50 (for example of the order of one half) is that which determines the speed of manufacture of the products wrapped in their first envelope or wrapping. In a preferred mode of operation, this speed is the same as that of the chain 64 and belt 74 which respectively drives and guides the extracting finger members 63. There is therefore, in normal operation, a progressive slowing down of the fragments of interior tobacco in the passageway 60 and in the forming funnel 80 where there is also effected a radial compression of the fragments owing to the inclination of the upper belt 84 with respect to the transfer belt 81.

It has been seen that this slowing down promotes the placing of certain fragments across the passageway 60, which is one of the desired effects, essential to the continuous devices carrying out the invention. In the event that this slowing down produces jamming, the speed of the fragments, at one or more points of the passageway 60, drops below the speed of manufacture and therefore below the speed of the extracting finger members 63 driven by the clain 64. The projection **63*a*, extending inside the passageway 60, thus strikes agains the accumulated tobacco and the corresponding finger member pivots about its pin 65 and slightly deforms the outer surface of the belt 74. This finger member then takes up the position shown in dotted line in respect of the finger member 63', its slightly concave part extending across the passageway and urging forward, at the speed of manufacture, the accumulation of fragments as soon as it is produced. The ramp 71' in acting on their pin 72, thereafter returns the finger members in the passageway 60 to a nominal position just before they leave the passageway 60. The fragments, which are reoriented so as to disorganize their initial stratification by their passage through the passageway 60 (and even in assuming an orientation perpendicular to the longitudinal axis of the roll if the shape and the dimensions of this passageway lends itself to this) are then compressed radially by the belt 84, the section of the roll becoming substantially square, then the section can be progressively transformed into a roughly circular section in the member 90 whereas the envelope or wrapping of reconstituted tobacco T surrounds it (at the same time as the belt 91**) as is conventional in this type of machine. The application of adhesive to an edge portion, the folding over of this portion, the drying of the joint, the cutting of the roll unit sections are also carried out in the usual manner.

This type of machine permits many modifications without departing from the scope of the invention. Thus the assembly comprising pulleys 76, 76' and trapezoidal belt 74 can be rendered movable in a direction parallel to passageway 60 so as to force the extracting finger members 63 to penetrate this passageway. The speed of these finger members may be modified (so as to be higher than that of the belts 51 to 54 for example) so as to obtain a re-orientation which is different from that obtained in the foregoing case. In a more simplified embodiment, the pulleys such as 76 can be mounted on the same shaft 67 as the wheel 66, which would render the foregoing modification impossible but permits a more compact construction of this device for precluding jamming.

Figure 9:
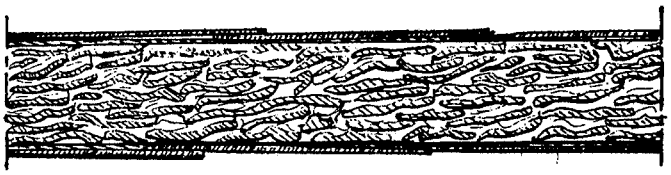
FIG. 9 is a diagrammatic longitudinal axial sectional view of a conventional cigar.
Figure 10:
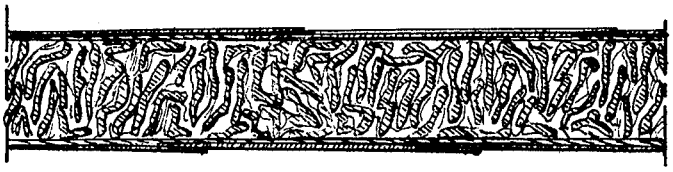
FIG. 10 is a diagrammatic longitudinal axial sectional view of a cigar according to the invention.

By a comparison of FIGS. 9 and 10, the structural differences between a conventional cigar and a cigar manufactured in accordance with the invention will be seen. In FIG. 9, the fragments are stratified so that an imaginary straight line parallel to the longitudinal axis of the cigar (and first and foremost the axis itself) passes through the direction of their least thickness only a small number of fragments. In any case, this line passes through the fragments at an angle of incidence which is very small, of the order of a few degrees.

On the other hand, in the product shown in FIG. 10, the orientation of the fragments is much less regular and has no longitudinal stratification. A straight line parallel to the axis would pass through a large number of fragments in the direction of their smallest thickness and, in any case, the major part of them would be intersected at a rather large angle of incidence, that is an angle which is equal to at least 15° and which could approach 90° for some fragments.

Figure 11:
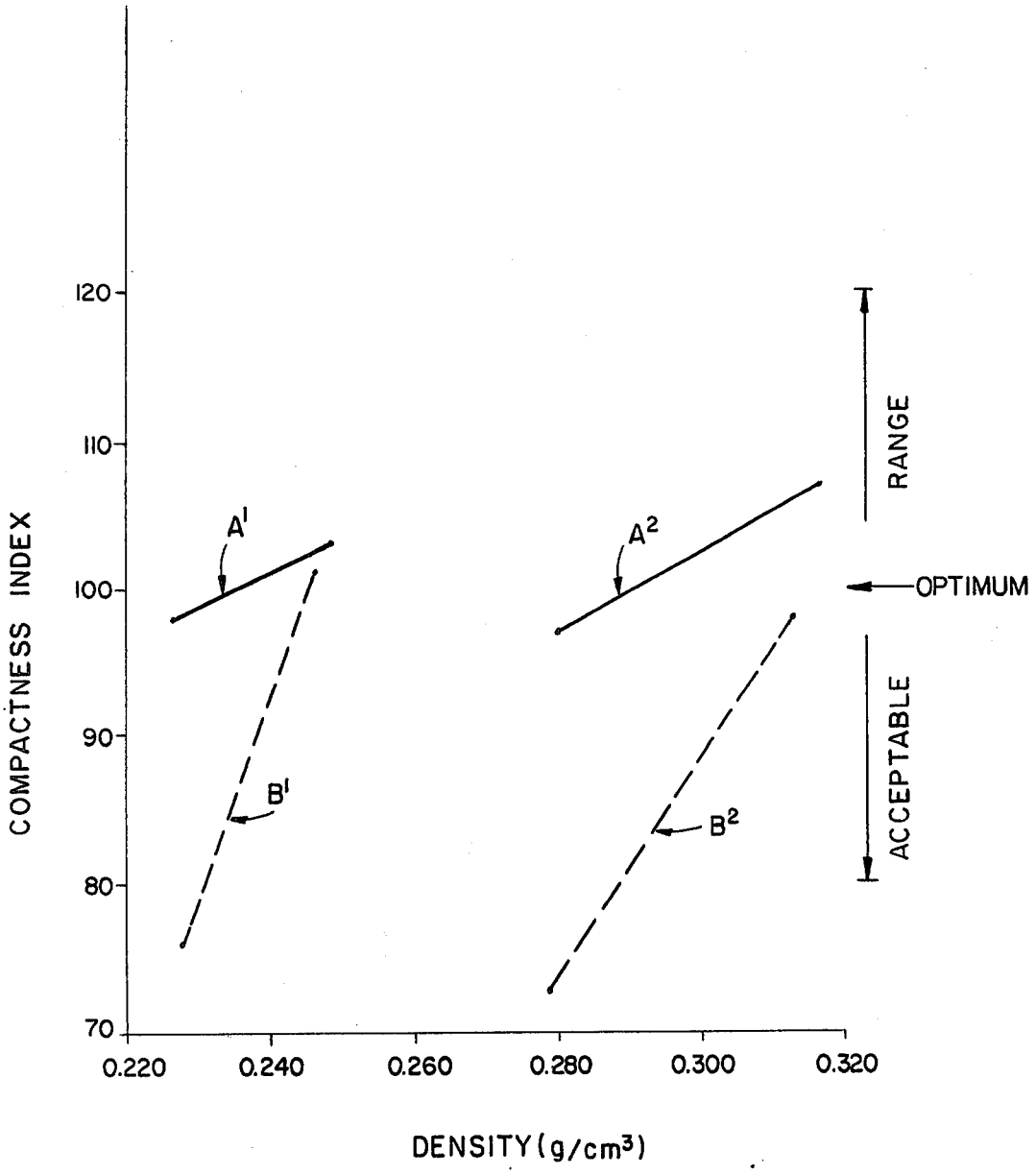
FIG. 11 is a plotting of the compactness index versus density for two products prepared according to the present invention ($A^1$ and $A^2$) and two products prepared according to prior art methods ($B^1$ and $B^2$).
Figure 12:
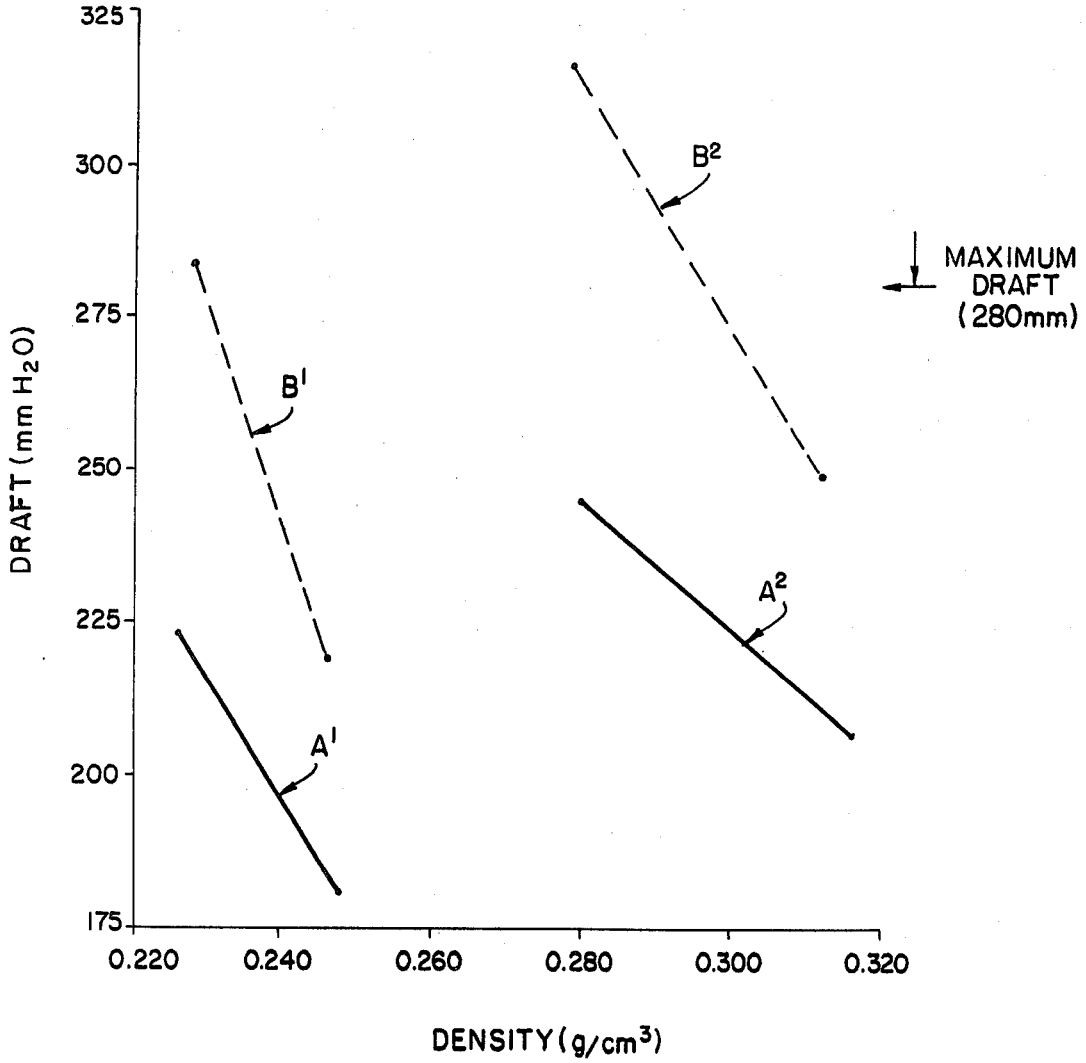
FIG. 12 is a plotting of draft properties versus density for the identical products referred to in connection with FIG. 11.

FIG. 11 presents the relationship of the compactness index to density for two products prepared according to the present invention ($A^1$ and $A^2$) and two prepared according to prior art methods ($B^1$ and $B^2$). FIG. 12 presents the corresponding relationship for draft properties as a function of density.

Compactness index was measured with a membrane apparatus (S.E.I.T.A.) at a product length of 70 mm, starting from 10 mm from the head. A compactness index of from 80 to 120 is generally regarded as acceptable by the trade and 100 is considered optimum.

Draft characteristics were measured with the SOLEX pressure apparatus, an occluded orifice giving a value of 0 mm while no resistance (a hollow tube) gives a value of 500 mm. A draft value above 280 mm is generally considered unsatisfactory as permitting excessively easy drawing.

All test values were the average for 100 samples. The specific values are as follows:

| Sample | Diameter (mm) | Length (mm) | Weight (g) | Density (g/cm³) | Compactness | Draft Index (mm $H_2O$) |
|---|---|---|---|---|---|---|
| $A^{1*}$ | 11.0 | 116 | 2.73 | 0.247 | 103 | 182 |
| | 11.0 | 116 | 2.49 | 0.225 | 98 | 223 |
| $B^{1*}$ | 11.0 | 116 | 2.71 | 0.245 | 101 | 220 |
| | 11.0 | 116 | 2.52 | 0.228 | 76 | 283 |
| $A^2$ | 11.2 | 155 | 4.81 | 0.315 | 107 | 207 |
| | 11.2 | 155 | 4.42 | 0.289 | 97 | 245 |
| $B^2$ | 11.2 | 155 | 4.78 | 0.313 | 98 | 249 |
| | 11.2 | 155 | 4.41 | 0.289 | 73 | 315 |

*Double wrapper panatella - continuous tobacco twist core with warm formed head.

From the above and from FIGS. 11 and 12 it can be seen that for conventional cigars, a very small change in density drastically affects its properties. Thus maintaining the same linear dimensions but reducing weight resulted in a product having an excessively high draft index and unacceptable compactness. This was true both for smaller conventional cigars of originally low density ($B^1$) and larger conventional cigars of somewhat higher density ($B^2$). On the other hand, the properties of the cigar-like products of the present invention vary less with changes in density (or weight, the linear dimensions being constant in both cases) and a significant reduction in weight can thus be effected while maintaining highly satisfactory draft index and compactness. This permits not only economies of production with no loss of user enjoyment but also a reduction in harmful components in the smoke.

What is claimed is:

1. A smokable cigar-like product comprising a plurality of prepared fragments of natural or manufactured tobacco leaves having irregularly contoured main surfaces whose dimensions of length and breadth are substantially greater than the thickness of the leaves, said fragments being compressed axially at constant cross-section into a rod-like shape with an orientation in said rod such that the major proportion of those fragments lying in a line parallel to the main axis of the product are encountered by said line at an angle of incidence relative to said main surface greater than zero with at least 30 percent of those fragments constituting said major proportion being encountered at a substantially perpendicular angle of incidence so as to be intersected by said line substantially through the direction of their initial thickness, and a smokable outer wrapping around said rod operable to coherently maintain the fragments in said orientation.

2. A smokable cigar-like product according to claim 1 wherein more than 50 percent of those fragments constituting said major proportion are encountered at a substantially perpendicular angle of incidence.

* * * * *